US007832492B1

(12) United States Patent
Eldridge

(10) Patent No.: US 7,832,492 B1
(45) Date of Patent: Nov. 16, 2010

(54) PORTABLE FIRE FIGHTING APPARATUS AND METHOD

(76) Inventor: John P. Eldridge, P.O. Box 202, Birchrunville, PA (US) 19421-0202

( * ) Notice: Subject to any disclaimer, the term of this patent is extended or adjusted under 35 U.S.C. 154(b) by 0 days.

(21) Appl. No.: 11/811,198

(22) Filed: Jun. 8, 2007

Related U.S. Application Data

(63) Continuation-in-part of application No. 10/889,872, filed on Jul. 13, 2004, now abandoned.

(51) Int. Cl.
*A62C 2/00* (2006.01)

(52) U.S. Cl. ..... 169/45; 169/24; 169/46; 239/198; 239/450; 239/547; 239/566

(58) Field of Classification Search ..... 169/16, 169/35, 43, 46, 47, 51, 52, 24; 239/450, 239/547, 566, 567, 1, 195, 198
See application file for complete search history.

(56) References Cited

U.S. PATENT DOCUMENTS

| | | | | | |
|---|---|---|---|---|---|
| 2,814,529 | A | | 11/1957 | Arnt | 299/104 |
| 3,047,241 | A | | 8/1961 | McLhinney | 239/273 |
| 3,033,470 | A | | 5/1962 | Choitz | 239/267 |
| 3,045,931 | A | | 7/1962 | Hall | 239/598 |
| 3,069,100 | A | | 12/1962 | Schuler | 239/522 |
| 3,176,773 | A | * | 4/1965 | Headrick et al. | 169/5 |
| 3,727,841 | A | | 4/1973 | Hengesbach | 239/145 |
| 3,738,429 | A | | 6/1973 | Heller et al. | 169/2 R |
| 3,762,478 | A | * | 10/1973 | Cummins | 169/24 |
| 4,162,041 | A | | 7/1979 | Hane | 239/266 |
| 4,168,799 | A | | 9/1979 | Turner | 239/145 |
| 4,330,040 | A | | 5/1982 | Ence et al. | 169/13 |
| 4,836,291 | A | * | 6/1989 | Owens et al. | 169/46 |
| 5,083,618 | A | | 1/1992 | Hayes | 169/54 |
| 5,265,802 | A | | 11/1993 | Hobbs et al. | 239/18 |
| 5,368,235 | A | | 11/1994 | Drozdoff et al. | 239/542 |
| 5,944,114 | A | | 8/1999 | Farley | 169/48 |
| 6,260,769 | B1 | | 7/2001 | Hoover | 239/145 |
| 6,343,615 | B1 | * | 2/2002 | Miller et al. | 137/202 |
| 6,360,968 | B1 | | 3/2002 | Orrange et al. | 239/273 |
| 6,450,264 | B1 | | 9/2002 | Christian | 169/16 |
| 6,637,518 | B1 | | 10/2003 | Hillier et al. | 169/46 |
| 6,685,104 | B1 | | 2/2004 | Float et al. | 239/63 |
| 6,719,065 | B2 | * | 4/2004 | Baughman | 169/52 |
| 6,761,226 | B2 | * | 7/2004 | Carrier et al. | 169/24 |
| 2002/0139543 | A1 | | 10/2002 | Baughman | 169/52 |

* cited by examiner

*Primary Examiner*—Christopher S Kim
(74) *Attorney, Agent, or Firm*—Petock & Petock, LLC; Michael F. Petock

(57) ABSTRACT

The present invention is a portable fire suppression apparatus. The fire suppression apparatus comprises a conduit with an open end and a closed end. In some embodiments of this invention the conduit may be a combination of several similar conduits connected with couplings with the last conduit having a closed end. The conduit has a plurality of apertures disposed upon its length at periodic intervals. When a fire suppression medium is forced throughout the conduit, the medium streams from each apertures and drenches the surrounding area and provides a fire break and air borne spark suppression capability. In the preferred embodiment, this apparatus also includes a means for stabilizing the conduit against rotation when high pressure medium is forced through.

14 Claims, 10 Drawing Sheets

FIG.1
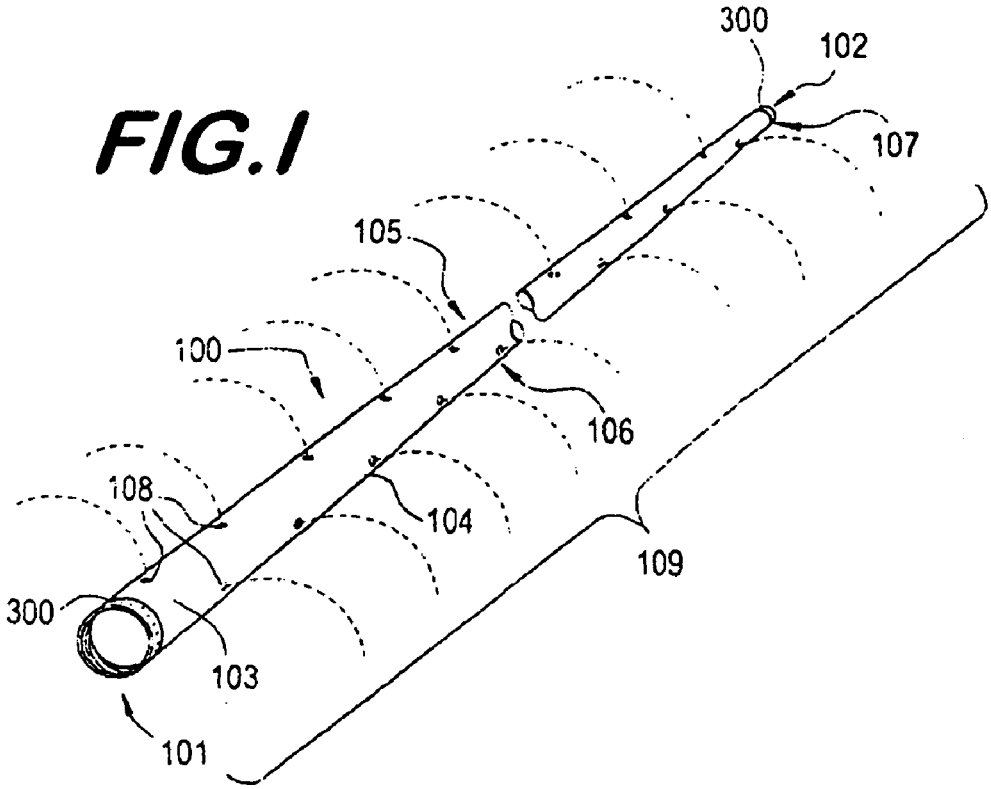
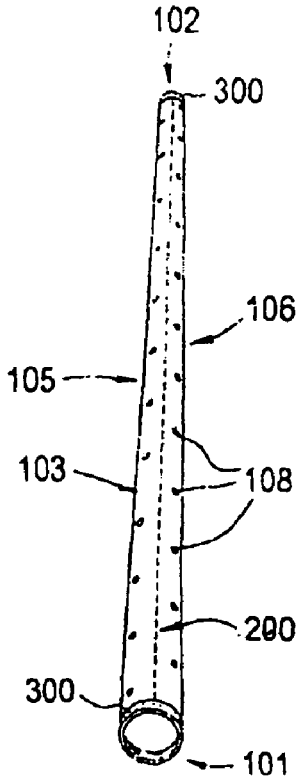
FIG.2

FIG. 5A
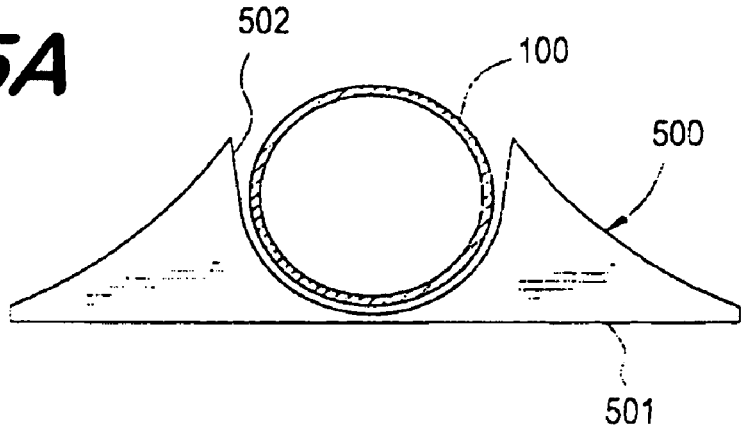
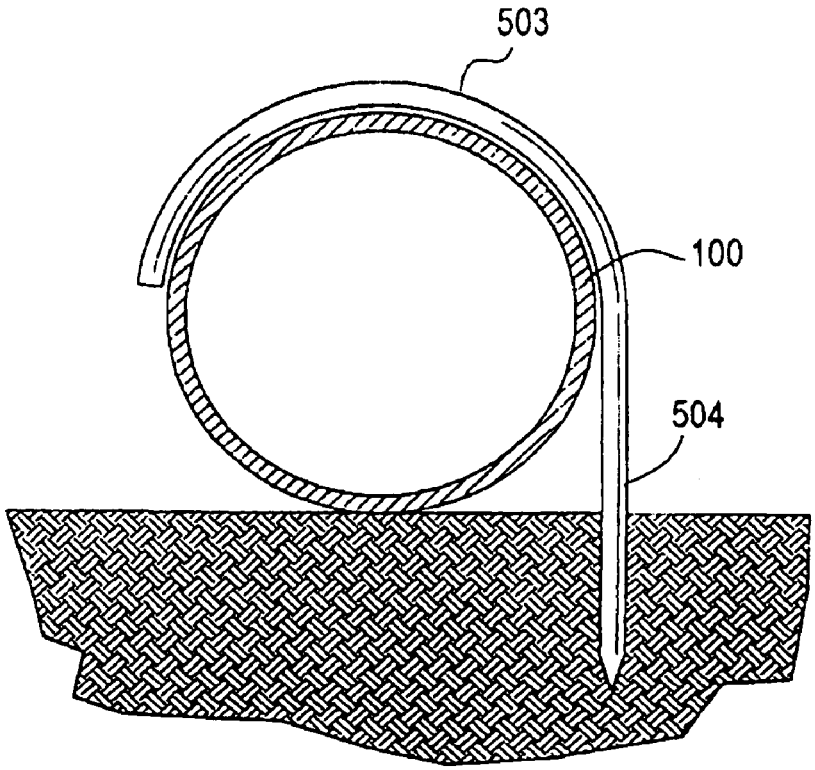
FIG. 5B

PORTABLE FIRE FIGHTING APPARATUS AND METHOD

CROSS REFERENCE TO RELATED APPLICATION

This application is a continuation-in-part of application Ser. No. 10/889,872 filed Jul. 13, 2004 now abandoned entitled PORTABLE FIRE SUPPRESSION APPARATUS by the inventor herein. Applicant claims the benefit of the filing date of this earlier application for so much as is common.

FIELD OF THE INVENTION

This invention relates generally to a fire fighting apparatus and method wherein rapid deployment over extended distances and uneven terrain is desired to create a fire break. Specifically, this invention relates to the use of releasably couplable portable conduits having a plurality of apertures along their lengths. Water forced through the conduit and out the apertures will wet the area along the length of the conduit creating a fire break. When sprayed upward, the water will tend to douse sparks carried by the wind. The conduit can be secured against rotation through the use of attached stabilizers or multiple side by side conduits. The invention is practiced in conjunction with a high pressure high volume water source such as is available from a fire engine pump.

BACKGROUND OF THE INVENTION

Every year fires of vegetation or vegetative fires such as brush and forest fires, both natural and man made, cause numerous deaths as well as considerable amounts of property damage. Due to the overwhelming danger that these fires can present, techniques and apparatus have been developed to both assist professional fire fighters and to protect lives and property.

SUMMARY OF THE INVENTION

The present invention relates to a portable fire fighting apparatus. The present invention comprises conduits capable of carrying large fluid flow rates (200 to 1000 gallons per minute) and containing high water pressures (70 to 600 psi) and having apertures disposed along their length at varying or periodic intervals. The apertures may incorporate nozzles. The conduits also incorporate means for detachably or releasably coupling with additional conduits and with a high pressure high volume water source. Several conduits may be coupled together to form a combined continuous length. The end of the conduit (or joined conduits) furthest away from the water source is closed. When the conduit is used in conjunction with a high pressure high volume water source, such as a fire engine pump, water sprays under pressure from the apertures drenching all areas within the spray's range and also act to douse sparks driven by wind across the wetted area. In embodiments of this invention in which the conduit comprises a flexible length of hose, the length of hose may be stored coiled about a large reel. This permits the hose to be rapidly moved and deployed to combat an approaching fire. In embodiments of this invention in which the conduits comprises a length of rigid or semi-rigid pipe, several pipes may be conveniently stacked for rapid deployment and connection. Variations in water pressure, pumped flow volume, and aperture size allow for variations in length of the apertured conduit over which an adequate volume of water may be delivered.

The conduit preferably incorporates a stabilizing means to prevent rotation about a longitudinal axis.

Briefly and basically, in accordance with the present invention, portable fire fighting apparatus is provided which includes a portable conduit having a first end and a second end. The portable conduit in a preferred embodiment would be round in cross section and would have a diameter of between 1.5 and 4 inches. A preferred embodiment would have a diameter of 3 inches. However, the conduit need not be round in cross section and may be square, rectangular, triangular or any other suitable shape and accordingly would have a cross sectional area between 1.75 square inches and 12.56 square inches.

The portable conduit of the present invention includes means for detachably or removably coupling the conduit which means are located at the first end and the second end of the conduit. At the second or final end of the conduit, means for sealing the conduit is provided. A plurality of apertures are located along the length of the conduit. The plurality of apertures are arranged longitudinally preferably in two or more planes. The two planes are preferably at an acute angle to each other. Means are provided to prevent rotation of the conduit about a longitudinal axis and means are provided for supplying the first end of the conduit with a fire retardant fluid, such as water, at a flow rate in excess of 200 gallons per minute. In this manner, the portable conduit may be arranged in an elongated fire break area to wet the fire break area to retard or stop a vegetative fire, such as a brush, field or forest fire.

In a presently preferred embodiment, the conduit may be flexible and may be constructed of the same structure as fire hose commonly used on fire trucks. Alternatively, the conduit may be rigid, such as PVC pipe or other lightweight structure which is easily installed and removed in a fire break area.

The means to prevent the rotation of the conduit about a longitudinal axis may be comprised of a plurality of conduits connected together side by side. Alternatively, the means to prevent the rotation of the conduit about a longitudinal axis may be a plurality of restraints spaced along the conduit which prevents the conduit from rotating about its longitudinal axis. Another embodiment of the means to prevent rotation about the longitudinal axis of the conduit may comprise two ridge extensions formed on a wall of the conduit. These ridge extensions may be 180 degrees apart or may be at some smaller angle such as 45 degrees apart.

Further, in accordance with the present invention, a plurality of conduits such as hoses or pipes may be connected together side by side wherein the plurality of conduits are also connected together with other sections longitudinally. In this arrangement, in order to tend to equalize the water flow pressure and spray height from the apertures, different ones of the plurality of conduits (sections) may be provided with apertures such that only one conduit section, such as a hose or pipe, within that section is provided with apertures. In other words, if there were two conduits connected together side by side, in the first section, one of the conduits may be provided with apertures and the other without apertures. In the next section, the conduit with apertures would be connected to the preceding section conduit without apertures. In this manner, although the second section conduit with apertures is located at a greater distance from the source, it would be provided with substantially the same pressure and water volume as the conduit with apertures in the first section.

Further, in accordance with the present invention, a method of fighting vegetative fires is disclosed which includes the steps of creating a fire break by wetting an elongated area with a fire retardant fluid. The wetting step includes the steps of laying out on the ground a conduit with an internal cross sectional area of at least 1.75 square inches and providing the conduit with apertures directed in two directions at least 15 degrees apart. The method further includes the step of providing a closure for one end of the conduit and providing means to inhibit longitudinal rotational motion of the conduit. In accordance with the method, fire retardant fluid may be forced into the conduit and out of the apertures at a rate of at least 200 gallons per minute to wet the longitudinal area to create a fire break to impede or stop a vegetative fire.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a view in perspective of the conduit of this invention with upwardly directed streams of water depicted in broken lines.

FIG. 2 is a top view in perspective of the conduit with a median line drawn for reference.

FIG. 5A is an elevation view partially in cross section of an alternative stabilizing bracket for use with the conduit of the invention.

FIG. 5B is an elevation view partially in cross section of another alternative stabilizing bracket for use with the conduit of this invention.

DETAILED DESCRIPTION OF THE PREFERRED EMBODIMENTS

Figure 2B:
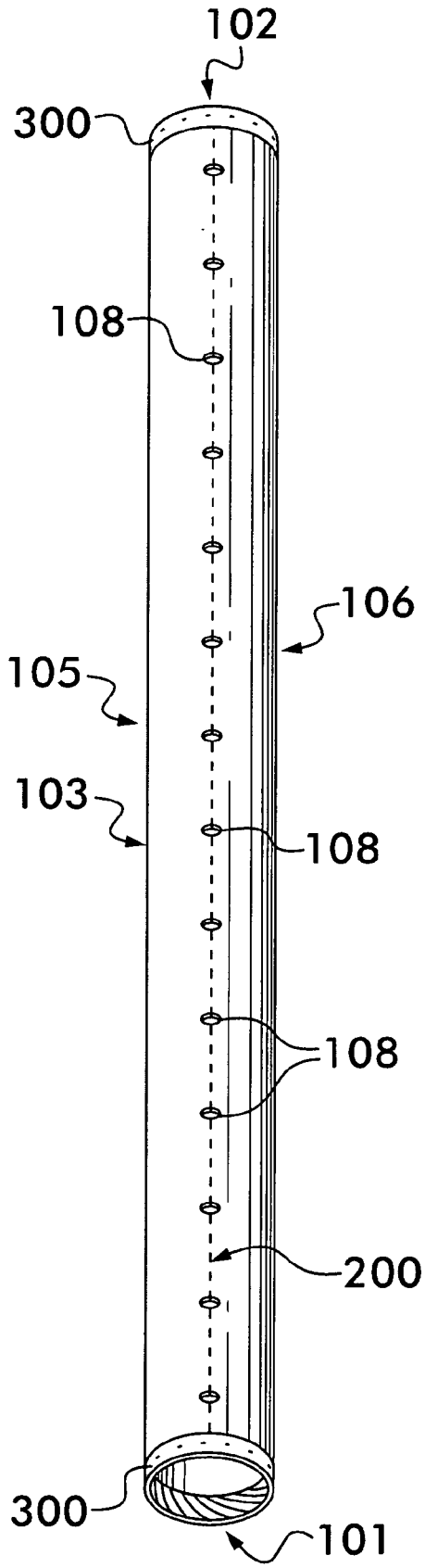
FIG. 2B is a top view in perspective of the conduit similar to FIG. 2 alternatively showing apertures 108 placed along the median line 200.

Outdoor fires often spread rapidly across large areas especially when a strong wind accompanies the fire. These fires may burn for weeks until they are brought under control such as has occurred in California, Florida, Georgia and in other areas. Standard techniques for halting or slowing the spread of fire often involve the creation of a fire break basically consisting of an area where no combustion can occur. Generally, fire breaks consist of extended areas, perhaps thousands of feet long, in front of the advancing fire. Due to the time required to create the breaks, they are usually placed well ahead of the anticipated direction the fire will take. The fire breaks are typically created by the deliberate stripping of combustible vegetation from the area by bulldozers, by the soaking of the vegetation with water, or by creating backfires along the projected path of the fire, Physical removal of the combustible vegetation is often used since it is difficult to deploy and supply water pumping apparatus over the extended lengths used to create the fire breaks. Water soaking of an area is generally limited to those situations where a structure is located which is desired to save from the fire.

The present invention provides an apparatus which permits water spray fire breaks (see FIG. 1) to be created over extended distances without the necessity of deploying pumping apparatus and their required water sources over the length of the break. The apparatus provides a soaked area to retard the advance of fire and a wet barrier to douse wind driven sparks and debris (see FIG. 1). The apparatus of the invention is easily portable and may be deployed relatively quickly and over uneven terrain. Such portability and ease of deployment permits a break to be created nearer the fire front thereby exposing less land to the possible ravages of the fire than can be accomplished where the break must be located further away to allow time for construction. The apparatus of the invention may also be used in conjunction with a fire break created by the stripping of vegetation to enhance the effectiveness of the break in stopping the spread of the fire. For purposes of this patent disclosure, the term "high pressure" refers to pressures in the range of 70 psi to 600 psi which are in excess of those typically provided by water mains or household water supplies. Typically, for instance, fire engine pumps may supply water at a pressure up to 600 pounds per square inch. Presently preferred pressure ranges may be in the range of 70 pounds per square inch to 200 pounds per square inch (psi)

The water or other fire retardant fluid provided to the portable fire fighting apparatus of the present invention is delivered not only under high pressure, but just, if not more, importantly at a high fluid flow rate. Preferably, the fluid flow rate would be between 200 and 1000 gallons per minute. By way of example, and not by way of limitation, an apertured conduit in accordance with the present invention may comprise a length of 400 feet with two rows of apertured directed at 45 degrees from the center line and, at a flow rate of 500 gallons per minute it would provide one inch of water over an area 30 feet wide by 400 feet long in about 15 minutes. A presently preferred flow rate is believe to be about 700 gallons per minute. However, it is understood that other flow rates may be utilized within the range set forth. Pressures, flow rates and use of large diameter fire hose type conduits are critical to the practicing of the present invention.

Referring now to the drawings, wherein like numerals indicate like elements, there is shown in FIG. 1 a cylindrical conduit 100 with a first end 101 and a second end 102. While the conduit shown is circular, for purposes of reference in this disclosure, a top portion 103, a bottom portion 104, a left side portion 105, and a right side portion 106 are defined. However, as discussed above, conduit 100 may be any suitable shape in cross section including any multi sided conduit including triangular, square, rectangular, pentagonal, hexagonal or any other number of sided conduit. Conduit 100 is of large cross sectional diameter. In the case of cylindrical conduit 100, the cross sectional internal diameter would be between 1.5 and 4 inches and preferably about 3 inches in internal diameter. A circular cross section conduit having a diameter of 1.5 inches would provide a cross sectional area of 1.75 square inches. A conduit having a circular cross sectional diameter of 4 inches would have a cross sectional area of 12.56 square inches. In the presently preferred embodiment of a circular inner diameter of three inches, the cross sectional area would be 7.06 square inches. As previously discussed, any other cross sectional shape having the same cross sectional area would provide the same benefits in practicing the present invention.

A plurality of apertures 108 are disposed along the length of the conduit as illustrated in FIGS. 1 and 2B. At each end 101 and 102 a coupling unit 300 is located which permits either the attachment of the conduit to a water source, to additional lengths of conduits, or permits attachment of a cap at the end furthest from the water source. In the preferred embodiment of the invention, the coupling units 300 at each end of the conduit 100 comprise fittings of a standard type designed to couple with the high pressure output of fire engine pumps. These couplings are detachable, releasable or removable to enable quick and easy coupling of sections of conduit together and to a source of high pressure high volume fire retardant fluid and for quick and easy removal from the fire break site once the fire break has been created by effective wetting. The removable or releasable couplings may be standard threaded fittings or quick connect and disconnect fittings such as those having projections on one end and a groove or slot on the other end to enable quick connection sealed by means of a rubber seal contained within the coupling.

Materials used in the manufacturing of fire hoses may be used in the construction of flexible conduits for this invention. Some examples of such hose materials include, but are not limited to single jacket hoses, double jacket hoses, nitrile coated hoses, pin rack hoses, covered fire hoses, hard suction hoses as well as booster fire hoses. Materials typically used in the manufacture of pipes may be used in construction of the conduits of this invention provided the wall thickness and/or material is sufficient to withstand the high pressures of up to 600 psi employed. In addition, the material from which the pipe is formed should be sufficiently light weight so that the pipe sections can be easily handled and deployed. Generally, plastic materials and pipe, such as Schedule 80 PVC pipe, which is commercially available can be employed in the manufacture of pipes for the apparatus of the invention. Alternatively, Schedule 40 PVC pipe, which is also commercially available, may be utilized in practicing the invention particularly for lower pressure ranges such as 70 psi to 200 psi.

As can be readily appreciated, high pressure water input at one end of the conduit 101, which is capped at the opposite end 102, will be forced out of apertures 108 along the conduit's length.

In FIG. 2 is a perspective top view of the conduit 100. For the purposes of defining aperture placement only, FIG. 2 shows a median line 200 on the top side 103 lying equidistant between the left side 105 and the right side 106. Apertures 108 may be placed along only one side of the conduit (to one side of the median line) or may be located on both sides of the conduit (on both sides of the median line). In a preferred embodiment, apertures 108 are placed on both sides of the conduit and lay within 45 degrees of the median line 200. This placement allows for a maximum range of water spray from the apertures. Alternatively, apertures 108 may be placed along the median line 200 as illustrated in FIG. 2B. However, where there are two radial planes of apertures where the planes are arranged in an acute angle, preferably the angle between the planes is greater than 15 degrees and less than 90 degrees.

In a preferred embodiment, conduits 100 are formed from flexible high pressure hose. In such conduits, the edges of the apertures may be reinforced by means well known in the art so that the force of water flowing through the apertures does not damage the flexible hose material. Many such hoses are manufactured in-side out and then inverted. This permits easy access for the reinforcement to be mounted. In an alternative embodiment in which the conduits are formed from piping, the apertures may also be reinforced.

In the simplest embodiments of the invention, the apertures comprise small round holes. However, apertures may be formed with nozzles of types well known in the art. Such nozzles may produce, for example, a single directed water stream or a wider water spray.

When a conduit is connected to a high pressure high volume water pump, water will be forced along the length of the conduit until it encounters the capped end. At this point, pressure will build up within the conduit and water will be forced out of the apertures along its entire length. The effective length of the conduit is the length over which sufficient water is discharged through the apertures to effectively soak the vegetation around the conduit to create a saturated area resistant to the spread of fire. Additionally, the water spray as illustrated in FIG. 1 acts to prevent fire spreading by wind driven sparks and embers. Several factors contribute to the effective length. Primary factors are: 1) the pressure and volume input to the conduit; 2) the diameter of the conduit; 3) the size of the apertures. Apertures designed to accommodate aperture plugs may be used to vary the number of open apertures along the length of the conduit to alter the effective length to that required in a particular circumstance. The apertures 108 may be uniformly/periodically distributed along the length of the conduit, or in particular circumstances may have other distribution patterns. For instance, in a long hose no apertures may be located near the high pressure water source so that the water spray does not start until some distance from the high pressure water source.

Ideally, the pressure at the aperture farthest from the pump should be sufficient to provide a desired water flow at the aperture. The diameter of the conduit is crucial to maintaining the water pressure throughout the length of the conduit. A significant pressure drop for each 100 feet is encountered with smaller diameter conduits. (For instance, the NFPA lists the pressure drop per unit length for hoses of different diameters.) Accordingly, the present invention is best practiced with larger diameter conduits and, most preferably, with inner diameters of at least 1.5 inches. This corresponds to a cross sectional area of 1.75 square inches. The conduits used in the present invention may be from 1.5 inches to 4 inches in inner diameter. Preferably, the conduit of the present invention would have an inner diameter or effective inner diameter (where it is non-round in cross section) of 3 inches. This would correspond to a cross sectional area of 7.06 square inches if some other cross sectional shape other than circular were utilized.

The slope of the terrain over which the conduit is deployed will also influence the effective length. Where the terminal (capped) end is significantly higher than the pump, a pressure drop will occur as a consequence of the need for the pump to force the water uphill. Conversely, when the terminal end is lower than the pump, there will be a pressure increase. In circumstances well understood in the fire protection art, pressure regulators may need to be placed between the adjacent conduit section on a downhill run to prevent the pressure from exceeding the burst pressure of the conduit. Additionally, on an uphill run booster pumps may be employed between the conduit sections when the pressure would otherwise decrease below a desirable threshold level.

Figure 3:
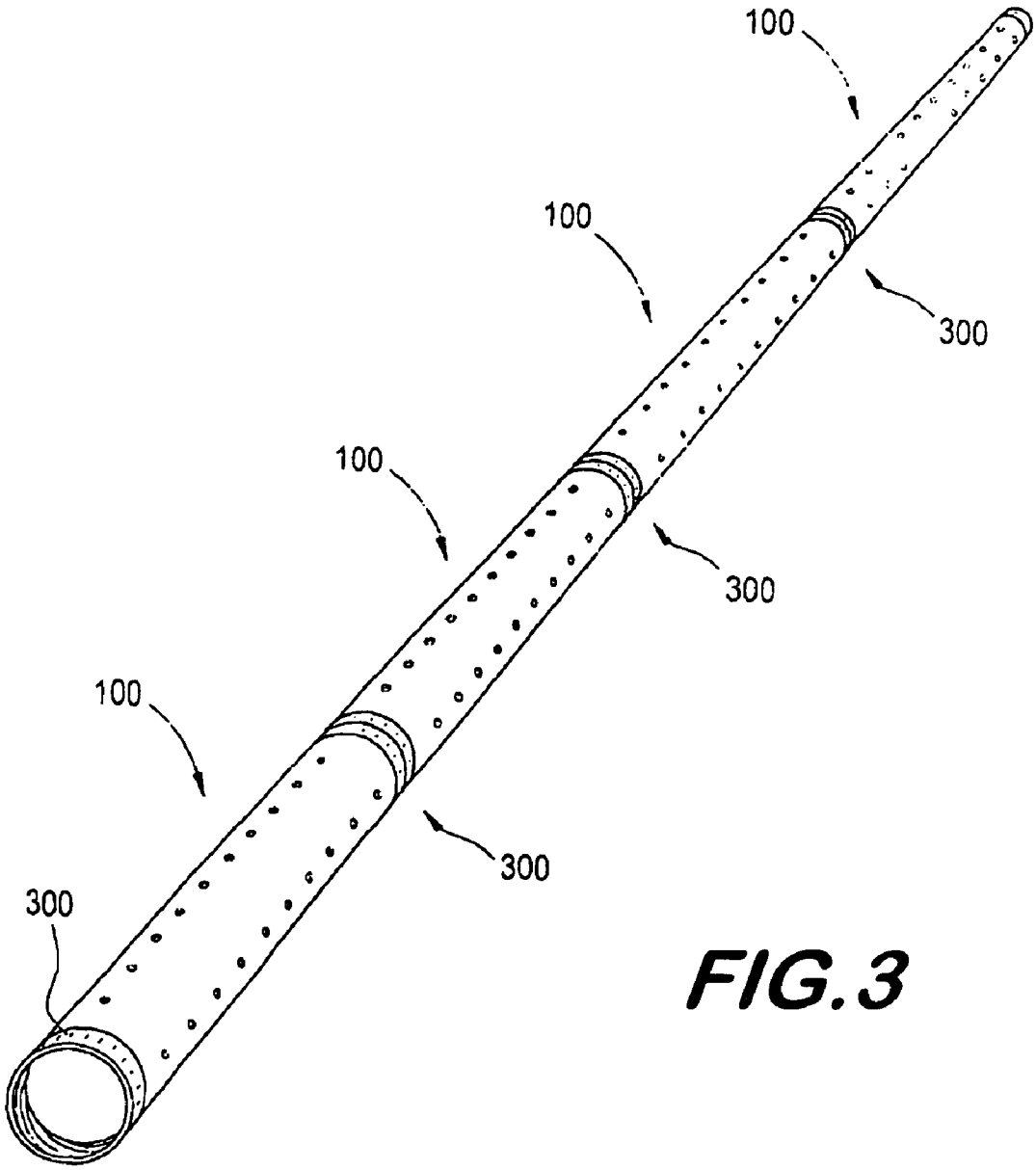
FIG. 3 is a view in perspective showing multiple conduit sections coupled together.

In FIG. 3, a side perspective view shows lengths of conduit 100 connected together in series via releasable couplings 300. The use of multiple lengths of conduit as opposed to a single continuous length permits the selection of an appropriate length for the fire break it is desired to establish. In addition, it is generally desirable to keep the pumping source (such as a fire engine) safely removed from the fire. In certain circumstances, the water source may also be located at some distance from the position where it is desired to establish a fire break. The present invention allows the use of sections of conduits (such as standard fire hoses), which do not have apertures, to be connected to the pump and then, at some distance away from the pump, to be connected to the apertured conduits of this invention. Multiple conduits may also be assembled in configurations such as switchbacks which allow for coverage of a large area rather than an elongated traditional fire break.

Figure 4:
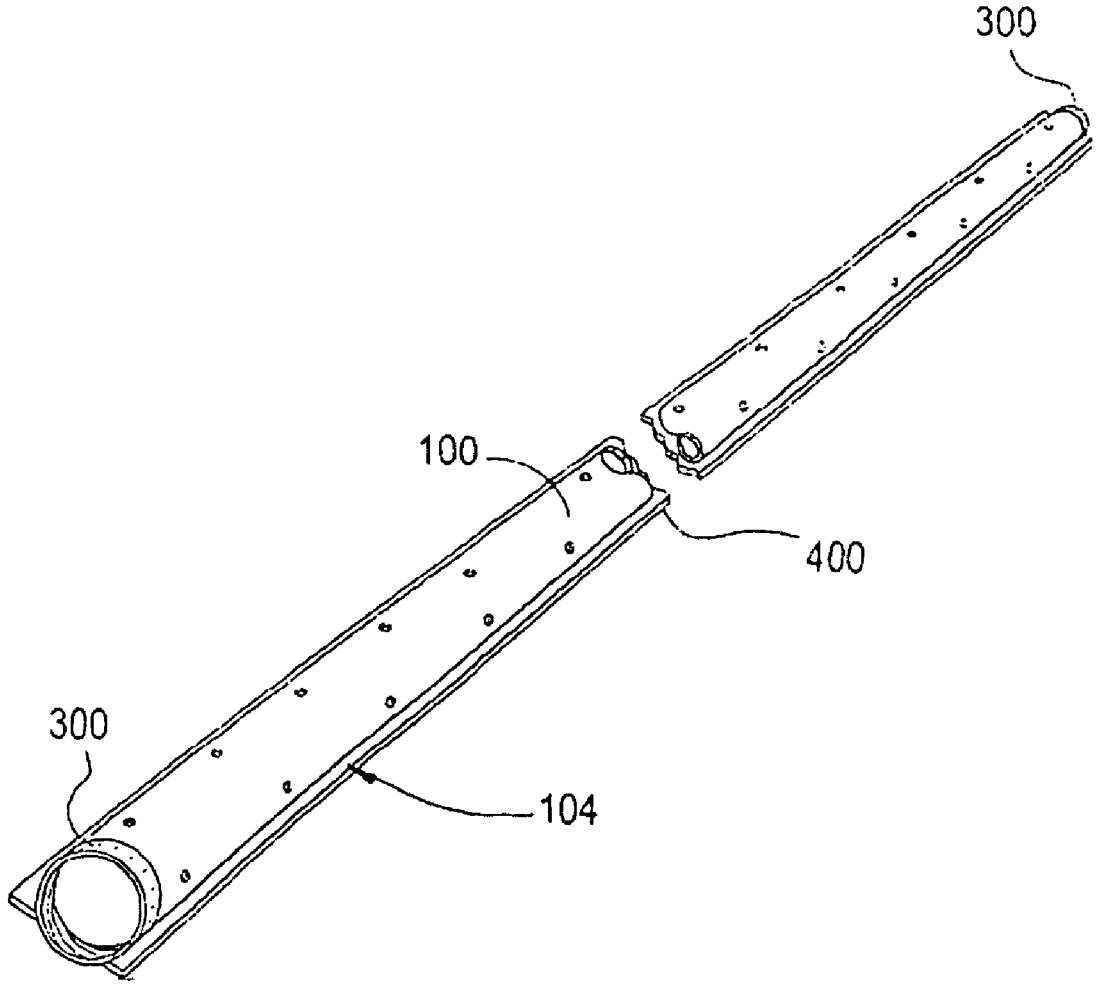
FIG. 4 is a view in perspective showing a flat stabilizer attached to the bottom of the conduit of the invention.

It can be appreciated that a substantially round conduit described above will be susceptible to rotation about its centerline when deployed. Such rotation would direct the water streams from the apertures in undesired directions such as, for example, directly into the ground. To prevent rotation, one of several means to stabilize the conduit may be employed. In FIG. 4, one such stabilizer is shown. A substantially flat support 400, which preferably extends beyond the sides of the conduit 100, is fixedly attached to the bottom 104 of the conduit. Preferably the support 400 is substantially resistant to flexing along its width but may flex along its length.

An alternative stabilizer is shown in cross section in FIG. 5A. Here the stabilizer consists of a bracket 500 having a bottom 501 and a receiving means 502 into which the conduit 100 is placed and restrained. An alternative stabilizing bracket shown in FIG. 5B has a receiving means 503 fixedly connected to a peg 504 which may be hammered into the ground to fix the conduit in place to prevent rotation.

Figure 6:
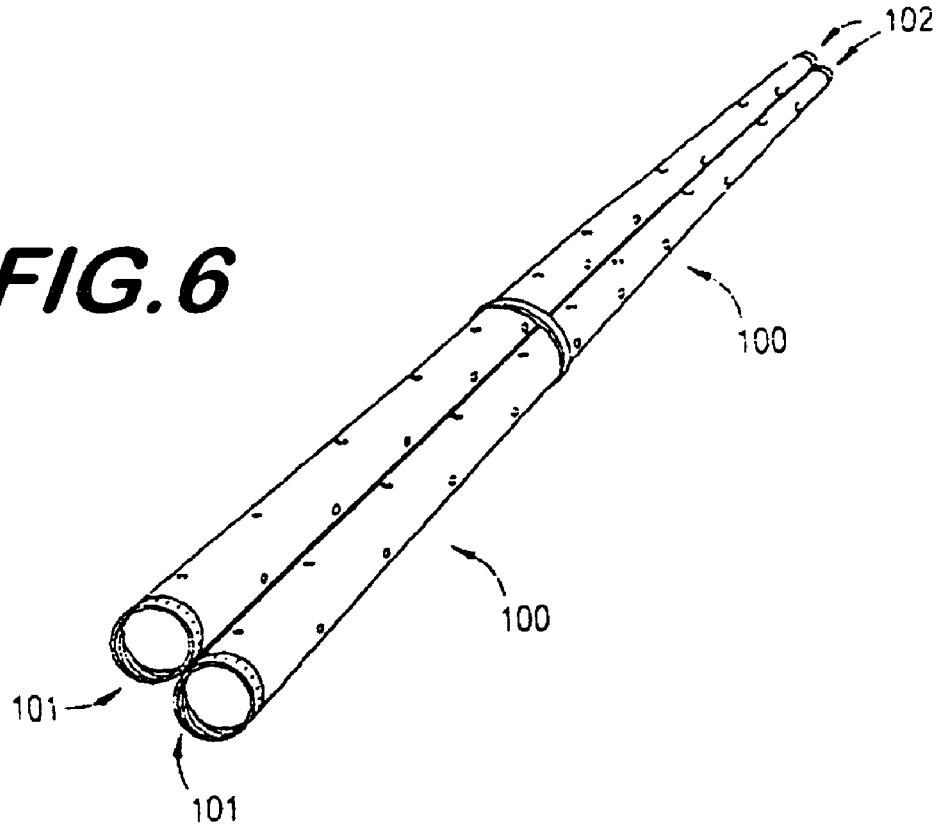
FIG. 6 is a view in perspective showing two attached conduits fastened together side by side.

An alternative method of stabilization, which may also be used to double the amount of water delivered for each length, is shown in FIG. 6. As shown diagrammatically, two conduits allows for added stability against rotation since each is prevented from rotating by the weight of the other. Fastening may be accomplished by any of the means well known in the art including but not limited to banding, brackets, adhesives, or weaving.

Figure 7A:
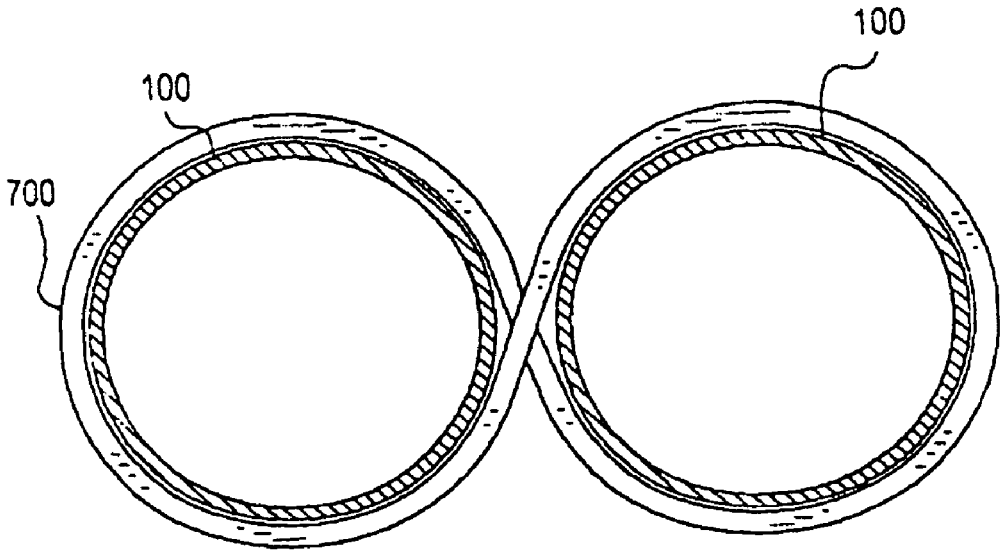
FIG. 7A is an elevation view partially in cross section of two conduits of the present invention attached with an attachment means encircling both conduits.

FIG. 7A shows a cross sectional view of a two conduits 100 fastened together by fastener 700. The fastener 700 employed is in the form of a metal or plastic band fastened around the exterior of the two conduits (not shown) or preferably fastened in a figure eight (as shown) about the exterior of the two fastened conduits 100.

Figure 7B:
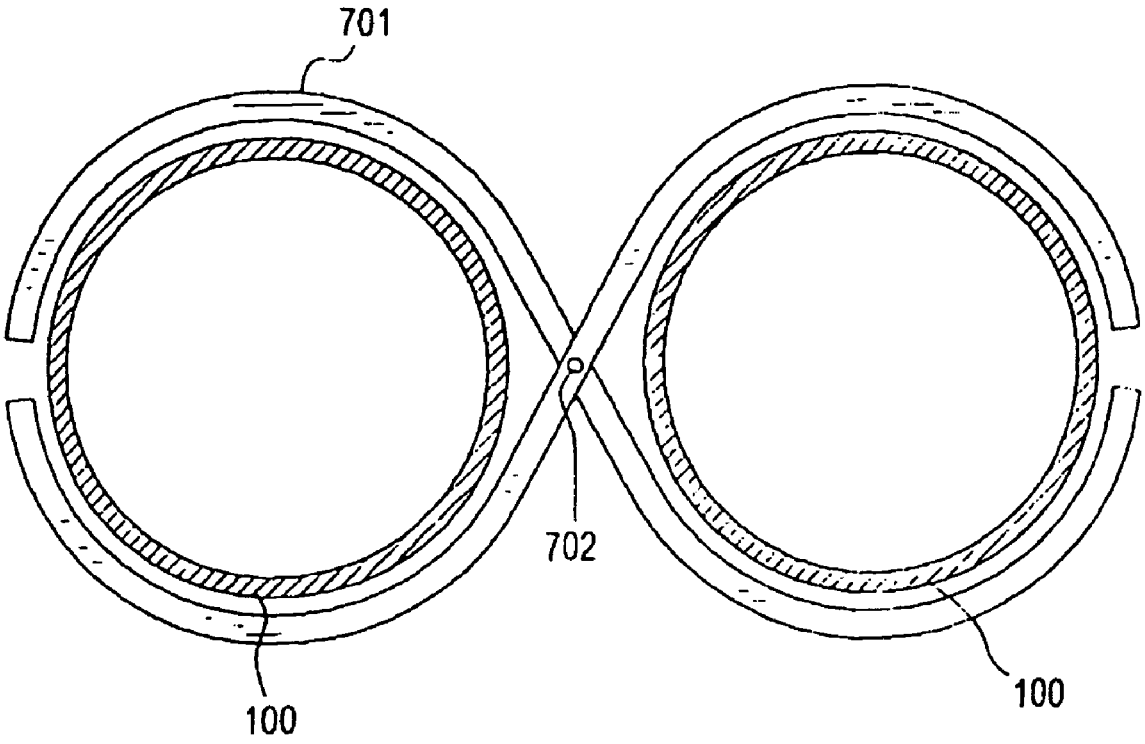
FIG. 7B is an elevation view partially in cross section of two conduits of the present invention attached with a detachable attachment means.

FIG. 7B shows a cross sectional view of two conduits fastened together by removable fastener 701. Fastener 701 may be constructed from plastic or metal and is in the shape of a figure eight with the left and right side open so as to allow rotation about a hinge pin 702 located at the central axis of the figure eight.

Figure 8:
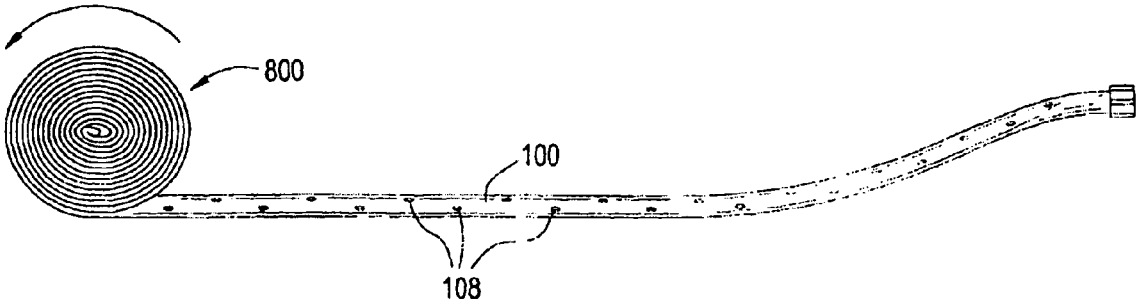
FIG. 8 is a side elevation view of the conduit of the present invention implemented as a flexible hose partially extended from a roll.

The portable fire fighting apparatus of this invention is used by placing and releasably coupling lengths of the conduit 100 along the length of the desired fire break. As shown in FIG. 8, the flexible version of the conduit of this invention, such as flexible hose, may be stored in rolls 800 which are transported to the location of the desired break. The hose may then be rapidly deployed by unwinding the rolls. Lengths of hose from several such rolls may be quickly releasably coupled to obtain the desired length keeping in mind the effect the terrain will have on the pressure. The stabilizing bracket shown in FIG. 4 may be rolled up with the hose and simultaneously deployed with the hose. A twin or double hose as shown in FIG. 6 may also be rolled up and deployed by unrolling. Alternatively, the brackets shown in FIGS. 5A and 5B may be fastened to the single hose at intervals as the hose is unwound from the roll. Brackets shown in FIGS. 7A and 7B may be used to fasten two hoses as the hoses are unwound. Since conduits comprised of hoses are relatively flexible even when pressurized, the hoses can conform to uneven terrain which may be encountered. Finally, if desired, a standard non-aperture hose may be used to connect the hose of the apparatus of this invention to a high pressure high volume water pump. It should be noted that while fire trucks are routinely used, any high volume high pressure water pump may be used with the apparatus of this invention. Examples of water sources for the pump include, but are not limited to fire hydrants, tanker trucks, water tanks, or swimming pools. The use of a rolled hose also permits a rapid repositioning of the fire break in response to changes in fire direction by merely rerolling the hose and unrolling the hose at the new desired position.

When conduits which comprise pipes are used, stacks of pipes may be transported to the desired site, removed from the transporter, and connected. A flexible connector (such as a length of flexible hose—not shown) may be used between pipe sections to permit the piping to conform to uneven terrain. The pipe may be connected directly to the high pressure high volume water pump but is preferably connected to the pump with flexible hose. Again, non-apertured conduit (such as pipe or hose) of suitable diameter may be used to transfer water some distance from the pump to the apertured piping of this invention. In appropriate circumstances, brackets as shown in FIGS. 5A and 5B may also be used with piping.

Figure 9:
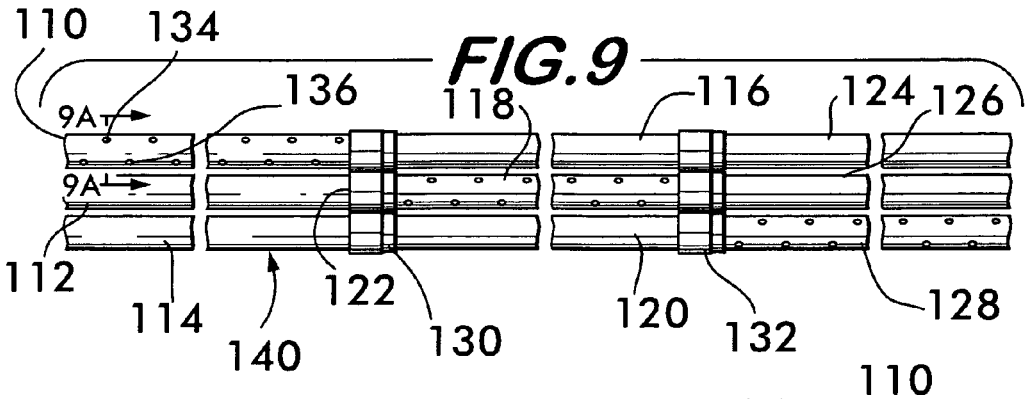
FIG. 9 is a plan view of another embodiment of the present invention showing three side by side conduits wherein apertured conduits alternate in tandem along the length of the conduit system.
Figure 9A:
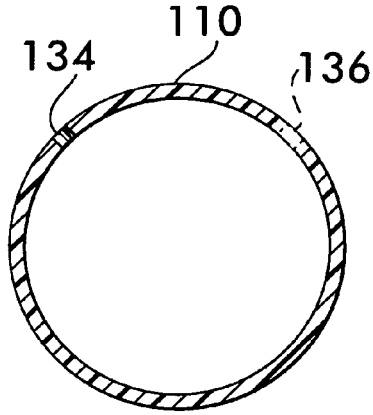
FIG. 9A is a cross sectional view taken along section line 9A in FIG. 9.

Referring now to FIG. 9, there is shown another embodiment 140 of the present invention wherein a plurality of conduits are connected together side by side and releasably coupled together in tandem. In each plurality section, only one of the conduits is provided with apertures. In this manner, the volume rate of flow through the apertures of each apertured section tends to be equalized even though it may be located at a greater distance from the source than another apertured section. Referring now more particularly to FIG. 9, there is shown a first plurality section comprised of three conduits 110, 112 and 114 connected together in a first section in side by side relationship. Only conduit 110 of the first section is apertured. The second section of releasably coupled together conduits is comprised of conduits 116, 118 and 120. Only second section conduit 118 is apertured. This is connected to non apertured conduit section 112 by releasable coupling 122. In this manner, second section 118 is receiving substantially the same volume and pressure of fire retardant fluid or water as section 110, considering the losses in non apertured conduit 112 negligible for the purposes of the present invention using large diameter pipe of at least 1.5 inches in diameter. The third section is comprised of conduits 124, 126 and 128. Only third section conduit 128 is apertured. Apertured third section conduit 128 is fed with a fire retardant fluid such as water through conduits 114 and 120 which are coupled together by releasable coupling 130. Third section apertured conduit 128 is connected to conduit 120 by releasable coupling 132. In this manner, apertured third section releasable coupling 128 receives substantially the same water flow and pressure as apertured conduits 110 and 118 as the losses in pressure and/or fluid flow rate are considered to be negligible through non apertured conduits 114 and 120. In this manner, the wetting effectiveness of the fire fighting apparatus of the present invention is made effective and tends to be more equal over long lengths of fire break. FIG. 9A shows a cross sectional view of apertured conduit 110 with aperture 134 and aperture 136 in dotted lines.

Figure 10:
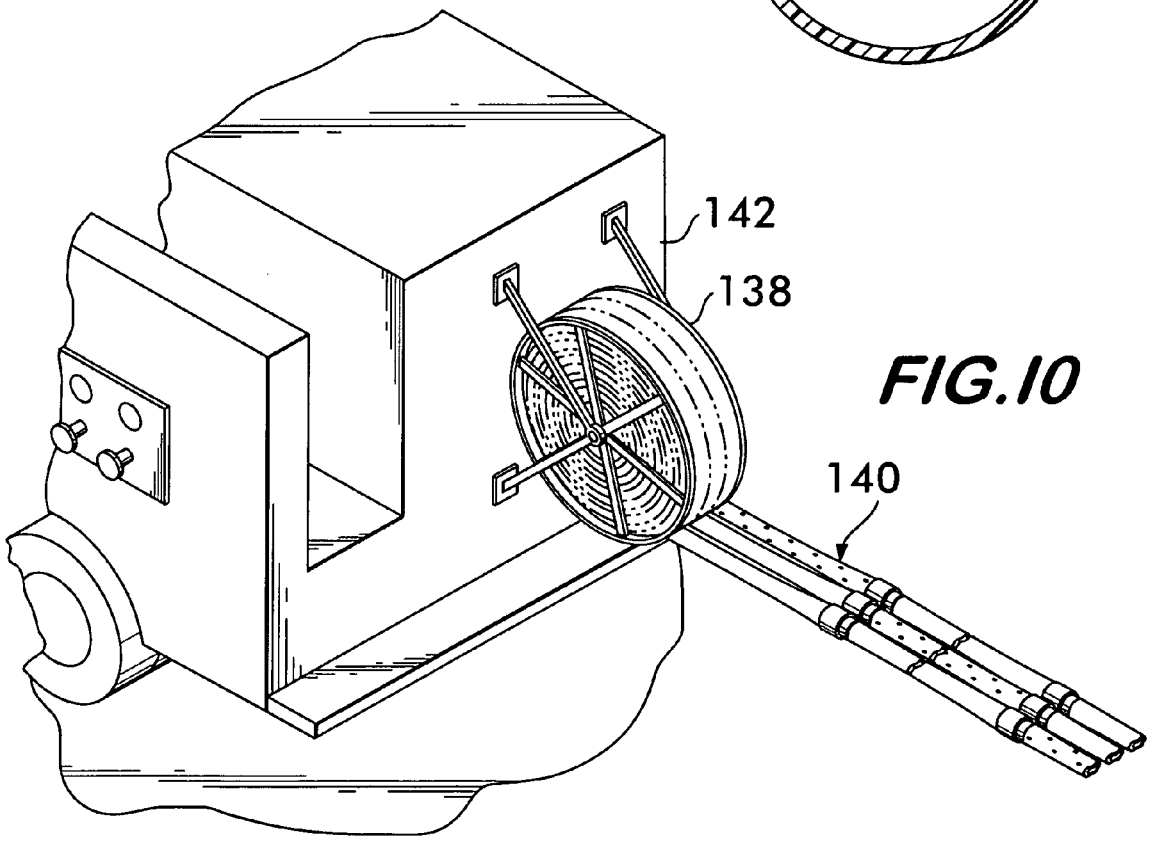
FIG. 10 is a view in perspective of an apparatus of the present invention comprised of three flexible conduits connected side by side being dispensed from a reel mounted to a fire truck wherein the apertures in the conduits alternate in sequential sections or in tandem.

FIG. 10 is a view in perspective of a reel 138 mounted to the back of a fire truck showing the triple tandem flexible conduit 140 of FIG. 9 being taken off of the reel 138. Reel 138 mounted to the back of fire truck 142 makes the transport of the portable fire apparatus of the present invention to a proposed fire break location simple, efficient and effective.

Figure 11:
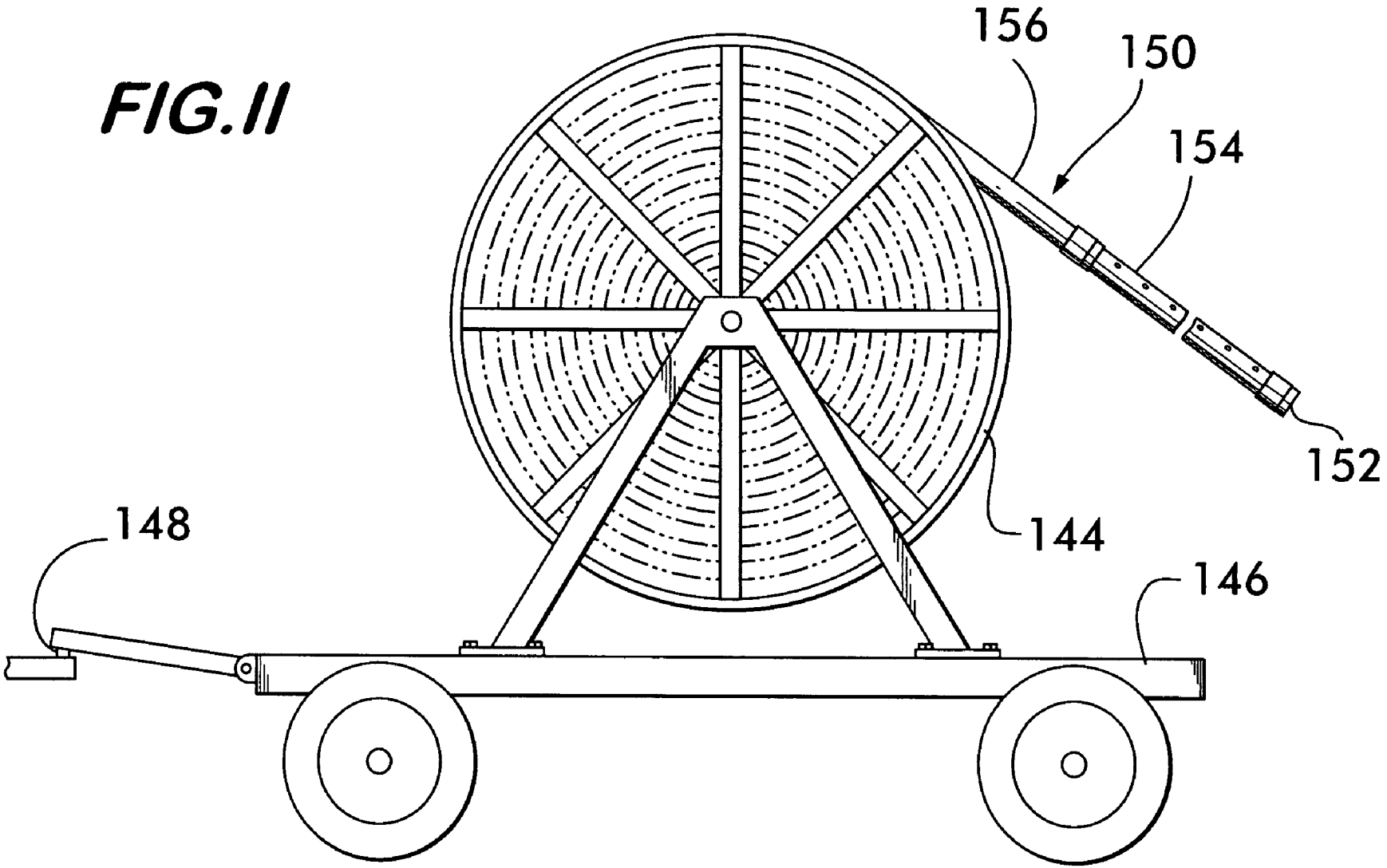
FIG. 11 is a side elevation view of a reel of flexible conduit in accordance with the present invention mounted on a portable trailer wherein flexible conduit is two side by side flexible conduits with alternating sections of apertures both in sequence and side by side.

FIG. 11 is a side elevation view of a conduit structure in accordance with the present invention comprised of two side by side connected together conduits similar to that disclosed in FIG. 9 coiled on a reel 144 mounted on a trailer 146. Trailer 146 may be connected to the back of a fire truck or other tow vehicle by means of hitch 148. In this manner, the fire fighting apparatus of the present invention may be readily stored for portable use and immediate deployment at fire fighting facilities, without the reels for the fire fighting apparatus being permanently mounted to the fire truck. However, when a brush or forest fire or other vegetative fire needs to be fought, and fire breaks need to be created, the trailer may be easily connected to the fire truck or other tow vehicle and quickly and efficiently drawn to the proposed location of the fire break. As illustrated in FIG. 11, the end of conduit 150 is provided with end caps 152. Last conduit 154 of the end section of dual conduit is shown with apertures and immediately preceding conduit 156 of the penultimate section is non apertured. Such an arrangement would alternate along the length of double conduit 150.

In appropriate circumstances, fire suppression materials other than water may be used with the apparatus of this invention.

It is understood that the present invention is not limited to the particular description set forth above but comprises any modification within the scope of the appended claims.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. A method of fighting vegetative fires including forest and brush fires, comprising the steps of:

deploying by transporting, to a desired site of a fire break, portable firefighting equipment comprised of at least two lengths of releasably couplable conduit with each conduit having a plurality of apertures, a high pressure high fluid flow rate pump which generates an output pressure of 200 psi to 600 psi and an output fluid flow rate of between 200 and 1000 gallons per minute and a conduit closure;

creating a fire break by wetting an elongated area of ground with a fire retardant fluid and creating a spray of fire retardant fluid upwardly directed;

said wetting and creating a spray steps including the steps of:

laying out on the ground said at least two conduits each with an internal cross sectional area of at least 1.75 square inches and with each conduit having at least one row of apertures centered on a plane substantially perpendicular to the ground on which said conduit is laid;

releasably coupling together said at least two conduits;

applying said closure to one end of said coupled conduits;

providing as a part of said portable firefighting equipment means to inhibit longitudinal rotational motion of said conduit;

supplying a fire retardant fluid to said site and supplying it to said high pressure high fluid flow rate pump; and forcing by said high pressure high fluid flow rate pump said fire retardant fluid into said conduit and out of said apertures at a rate of at least 200 gallons per minute to wet the longitudinal area and to create a spray of fire retardant fluid to create a fire break to impede or stop a vegetative fire.

2. A method of fighting vegetative fires in accordance with claim 1 wherein said step of deploying by transporting portable firefighting equipment comprised of at least two lengths of releasably couplable conduit with each conduit having a plurality of apertures is a step wherein said conduit is flexible conduit with each flexible conduit having a plurality of apertures.

3. A method of fighting vegetative fires in accordance with claim 2 wherein said step of deploying by transporting portable firefighting equipment includes the step of transporting said flexible conduit on a reel.

4. A method of fighting vegetative fires in accordance with claim 1 wherein said step of deploying by transporting portable firefighting equipment comprised of at least two lengths of releasably couplable conduit with each conduit having a plurality of apertures is a step wherein said conduit is rigid releasably couplable conduit with each conduit having a plurality of apertures.

5. A method of fighting vegetative fires in accordance with claim 1 wherein said step of deploying by transporting portable firefighting equipment comprised of at least two lengths of releasably coupable conduit with each conduit having a plurality of apertures is a step wherein said conduit is circular in cross section with each conduit having a plurality of apertures.

6. A method of fighting vegetative fires in accordance with claim 1 wherein said step of deploying by transporting portable firefighting equipment comprised of at least two lengths of releasably coupable conduit is a step wherein said conduit is pipe.

7. A method of fighting vegetative fires in accordance with claim 6 wherein said pipe is constructed of polyvinylchloride.

8. A method of fighting vegetative fires including forest and brush fires, comprising the steps of:

deploying by transporting, to a desired site of a fire break, portable firefighting equipment comprised of a least two sections with each section having at least two conduits, the conduits of each section being connected together side by side along their longitudinal length, each of said conduits having a cross-sectional area of at least 1.75 square inches, a plurality of apertures in one of the conduits of each section, a high pressure high fluid flow rate pump which generates an output pressure of 200 psi to 600 psi and an output fluid flow rate of between 200 and 1,000 gallons per minute and a conduit closure for each conduit of a terminal section;

releasably coupling ends of the conduits of at least the first and second sections together;

said step of releasably coupling the ends of the conduits of at least the first and second sections including the step of coupling an apertured conduit in one section to a non-apertured conduit in the next section;

connecting said high pressure high fluid flow rate pump to be in fluid communication with an input of a coupled at least first and second sections of conduit;

applying said conduit closures to terminal ends of the conduits of a terminal section;

supplying a fire retardant fluid to said high pressure high fluid flow rate pump and operating said pump; and, forcing said fire retardant fluid by means of said pump out of said apertures to wet the ground and create a spray of fire retardant fluid dowsing flying embers and creating a fire break.

9. A method of fighting vegetative fires in accordance with claim 8 wherein said step of deploying by transporting portable firefighting equipment comprised of at least two sections with each section having at least two conduits wherein said conduits are flexible.

10. A method of fighting vegetative fires in accordance with claim 9 wherein said step of deploying by transporting portable firefighting equipment includes the step of transporting said flexible conduit on a reel.

11. A method of fighting vegetative fires in accordance with claim 8 wherein said step of deploying by transporting portable firefighting equipment comprised of at least two sections with each section having at least two conduits wherein said conduits are rigid.

12. A method of fighting vegetative fires in accordance with claim 8 wherein said step of deploying by transporting portable firefighting equipment comprised of at least two sections with each section having at least two conduits wherein said conduits are circular in cross section.

13. A method of fighting vegetative fires in accordance with claim 8 wherein said step of deploying by transporting portable firefighting equipment comprised of at least two sections with each section having at least two conduits, wherein said conduits are pipe.

14. A method of fighting vegetative fires in accordance with claim 13 wherein said pipe is constructed of polyvinylchloride.

* * * * *